United States Patent [19]

Clifft et al.

[11] 4,103,464

[45] Aug. 1, 1978

[54] TOOL FOR BLOWING INSULATION INTO AN EXISTING WALL STRUCTURE

[75] Inventors: Dale L. Clifft, Tarzana; Melvin G. Green, San Diego, both of Calif.

[73] Assignee: Melvin G. Green, Inc., San Diego, Calif. ; a part interest

[21] Appl. No.: 770,006

[22] Filed: Feb. 18, 1977

[51] Int. Cl.[2] ..... E04G 21/00

[52] U.S. Cl. ..... 52/127; 52/173 R; 52/743; 52/749; 141/329; 428/71; 428/314

[58] Field of Search ..... 141/329; 222/81, 83, 222/90; 52/749, 127, 173, 743, 744; 228/218 N, 214.2, 214 R; 428/71, 314; 156/77–79

[56] References Cited

U.S. PATENT DOCUMENTS

| | | | |
|---|---|---|---|
| 2,592,081 | 4/1952 | Toulmin | 156/79 |
| 2,788,552 | 4/1957 | Miles | 52/127 |
| 2,863,797 | 12/1958 | Meyer | 428/425 |
| 3,007,208 | 11/1961 | Urban | 428/425 |
| 3,151,427 | 10/1964 | Meissner | 156/79 |
| 3,194,853 | 7/1965 | Weise | 52/127 |
| 3,560,285 | 2/1971 | Schroter | 156/77 |
| 3,785,913 | 1/1974 | Hallamore | 428/71 |
| 3,957,048 | 5/1976 | Jacobs | 128/214 R |
| 4,002,002 | 1/1977 | Barnhardt | 52/743 |
| 4,002,174 | 1/1977 | Reed | 128/214 |

*Primary Examiner*—Stephen J. Novosad
*Assistant Examiner*—Henry Raduazo
*Attorney, Agent, or Firm*—Jack C. Munro

[57] ABSTRACT

The apparatus and method of supplying pulverized insulative material to within an existing wall structure which already has a pad of insulative material located within the wall. An access opening is provided through the outer surface of the wall. The tool is formed in substantially a right angle and is to be connectable to a machine for blowing insulation. The outer edge of the tool includes a cutting edge and the outer surface of the tool adjacent the cutting edge is formed slightly arcuate. The cutting edge portion of the tool is inserted through the access opening and moved against the pad of insulation thereby cutting such until the cutting edge of the tool is located directly adjacent the backing layer of material of the pad of insulation. At this time the tool is then pivoted causing the tool to penetrate the backing layer of material and continuing to pivot the tool causes the tool to be located between the backing layer of material and the inner wall. The arcuate surface of the free end of the tool facilitates sliding movement of the tool against the inner wall. At this time the insulation may be blown with air pressure through the tool to be deposited within the interior opening of the wall structure.

4 Claims, 7 Drawing Figures

2
2
10
40
40
18
18
20
20
40
40
14

20
14
40
34
28
38
36
3
3
30
22
16
12
44
26
24
32

34
36
38

12
20
14
40
36
34
28
38
30
24
22
44
16
26
32

20
12
14
36
30
28
40
34
38
44
24
32
26
22
16

12
20
14
40
28
30
36
32
44
24
22
34
38
16
26

20
14
12
42
40
28
36
30
44
32
24
AIR
PRESSURE
34
26
38
22
16

TOOL FOR BLOWING INSULATION INTO AN EXISTING WALL STRUCTURE

BACKGROUND OF THE INVENTION

The current construction technique of houses and buildings requires the placing of insulation within the exterior walls of the structure. The most economical way of accomplishing this is to employ a pad of insulation material, usually three to four inches thick of fiberglass. On one side of the fiberglass there is located a backing strip which is usually of paper. This backing strip of material provides sufficient strength to the overall structure to facilitate installation and location within the openings between the studs and between the inner and outer wall surfaces of the wall.

Usually the amount and quality of insulation within the wall is what is minimumly required. After the structure is built and occupied, at some later date, the owners of the property may desire to place further insulation within the walls.

Prior to this invention, the normal procedure was to cut a plurality of access openings through exterior wall surface which connect with the interior openings or chambers within the wall with there being at least two in number of such chambers between each pair of studs. A tubular member (or conduit) would then be inserted through the access opening in direct contact with the fiberglass insulation material. Insulation would then be blown through the conduit into the wall chamber. However, because of the inherent "flimsiness" and ability to pass air of the fiberglass insulation, the blown insulation would tend to quickly pack around the access opening and as a result only a small amount of insulation could be blown into the wall chamber.

It would have been more desirable to conduct the insulation into the wall chamber through the inner surface of the wall. However, this would require a substantial number of access openings to be formed through the interior walls of the building or house. This is just not feasible as the holes would require substantial remodeling with the interior of the structure and damage to the interior furnishings could result due to the presence of workmen and equipment. The reason it was so desirable to place the insulation from the inside was that the tool could come into contact with the backing layer of material and this would supply sufficient rigidity and as the insulation is blown into the wall chamber, the backing layer of material with the aid of air pressure will merely push against the fiberglass and compress the fiberglass thereby forming an enlarged area for the blown insulation to be received. Additionally, the possibility exists of puncturing the backing layer when drilling the access holes which could cause the positive air pressure to occur on the exterior side of the backing layer.

SUMMARY OF THE INVENTION

The structure and method of this invention is believed to be summarily described in the Abstract of The Disclosure and reference is to be had thereto.

The primary objective of this invention is to provide a tool to supply additional insulation to an exterior existing wall through the exterior wall surface, such insulation being of higher quality and being capable of being provided in great quantities thereby achieving substantially greater insulative characteristics.

A further objective of this invention is that the blown insulation will be uniformly received through the entire wall chamber though it is only supplied through a single access opening into that chamber.

A further objective of this invention is that the tool of this invention is constructed of few parts and can be readily manufactured inexpensively.

DETAILED DESCRIPTION OF THE SHOWN EMBODIMENT

Figure 1:
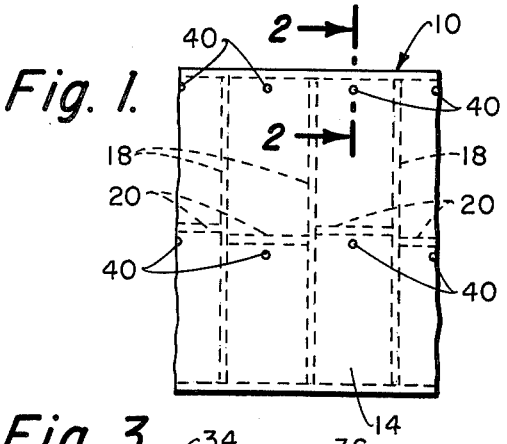
FIG. 1 is a view of an exterior wall structure of a building or house to which additional blown insulation is to be provided to within the interior of the wall.

Referring particularly to the drawing, there is shown in FIG. 1 a segmental view of a wall structure 10 of a building or house. The wall structure 10 is deemed to be conventional and is to comprise an inner wall 12 and an outer wall 14. The wall 12 will normally be of a plaster or dry wall construction. The outer wall 14 will normally be of a wood or stucco type of construction. However, the outer wall 14 could be of almost any type of conventional exterior wall construction.

The inner wall 12 is separated from the outer wall 14 by a chamber or opening 16. This spacing will normally be one and a half to six inches but may be eight inches or more. This spacing between the inner surface 12 and the outer surface 14 is created through the use of vertical studs 18 and horizontal braces 20.

Located within the wall chamber 16 is a pad 22 of insulation material. The pad 22 of insulation material is composed of a thickness of one to six inches of fiberglass 24 to which has been secured on one side thereof a backing layer of material 26. The backing layer of material 26 will normally be of paper and although it is not shown, the sides of the paper of the backing layer 26 extend beyond the sides of the fiberglass insulation. It is these edges that facilitate attachment by staples or other types of conventional fastening means to the vertical studs 18 thereby locating at a proper position within the wall chamber 16 the pad of insulative material. The pad of insulative material will be located within each and every wall chamber 16 of the exterior surface of the exterior wall 10.

The tool 28 of this invention takes the form of a conduit or tubular member 30 having an internal opening to be capable of conducting blown insulative material therethrough. The tubular member 30 terminates in an inner end 32 and an outer end 34.

Intermediate the ends 32 and 34 the tubular member 30 includes a right angled elbow 36. This elbow 36 is formed merely by deforming the tubular member 30. The location of the elbow 36 is quite important as will be explained further on in the specification.

The outermost edge of the end 34 includes a cutting edge 38. Also, the surface of the end 34 is smoothly contoured into a slightly convex arcuate curve. The reason for this will also be explained further on in the specification.

Figure 2:
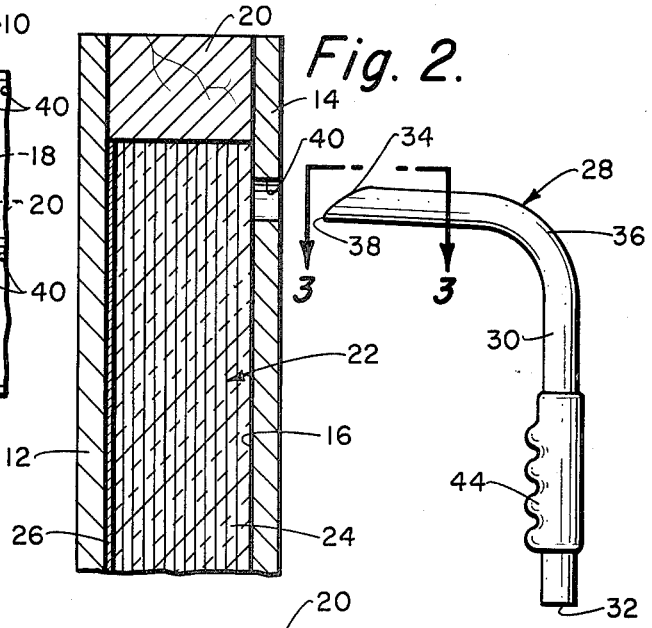
FIG. 2 is a cross-sectional view taken along line 2—2 of FIG. 1 showing the initial position of the tool of this invention prior to connection with the wall.
Figure 3:
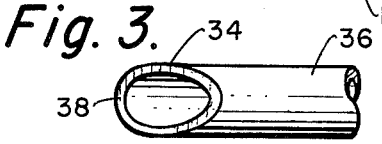
FIG. 3 is a partial view of the outer end of the tool of this invention taken along line 3—3 of FIG. 2.
Figure 4:
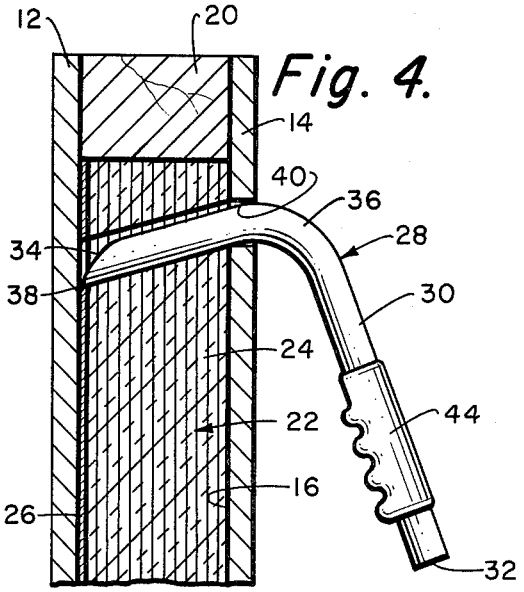
FIG. 4 is a cross-sectional view similar to FIG. 2 showing the tool at a first intermediate position within the wall with the end of the tool in contact with the backing layer of material of the pad of insulation located within the wall.
Figure 5:
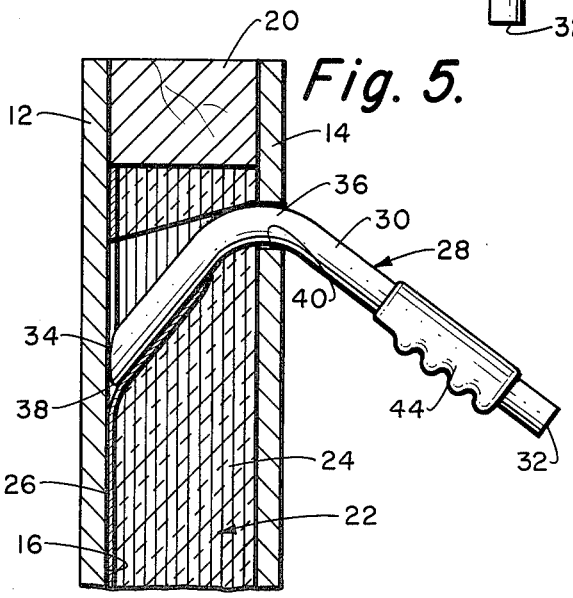
FIG. 5 is a view similar to FIG. 4 but showing the tool in a second intermediate position having cut through the backing layer of material.

In the operation of the tool 28 of this invention, a plurality of access openings 40 are located within the outer wall 14. The size of the access opening 40 is just to accommodate the diameter of the tubular member 30 and space required for the bend to pass through. The operator places the tubular member 30 in the position shown within FIG. 2 and proceeds to insert the end 34 of the tubular member 30 through the access opening 40. Referring particularly to FIG. 4 of the drawing, the insertion is not accomplished precisely horizontal but the tool is canted slightly at approximately twenty degrees so that the end 34 is moved slightly downward as it penetrates the pad 24 of fiberglass.

Upon the cutting edge 38 of the tool coming into contact with the backing strip 26, the operator then exerts a slightly increased amount of pressure causing penetration of the backing layer 26. The operator then proceeds to maintain the end 34 into continuous contact with the inner wall 12 and then begin to pivot the tubular member 30. At the beginning of this pivoting movement, the cutting edge 38 continues to gouge a larger sized opening within the layer 26. However, as the tubular member is pivoted a certain point is reached which causes the cutting edge 38 to become disassociated from the inner wall 12. However, the end 34 is still maintained in contact with the inner wall 12 and because the inner end 34 is formed arcuate (smoothly contoured), the movement of the end 34 across the inner wall 12 is accomplished with ease. In other words, the end 34 of the tubular member 30 slides quite easily across the inner wall 12.

As previously mentioned, because the cutting edge 38 is no longer in contact with the inner wall 12, there is no further cutting of the layer 26. As also previously mentioned, the location of the elbow 36 is important so that as the tubular member 30 is pivoted, the elbow 36 is conducted through the access opening 40.

Figure 6:
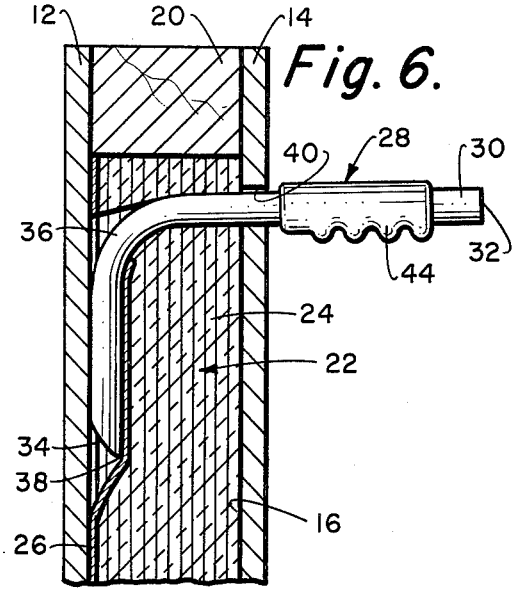
FIG. 6 is a view similar to FIG. 5 but showing the tool completely pivoted and located between the backing layer of material with the pad of insulation and the inner wall surface and ready to have a mixture of air and insulation blown through the tool.
Figure 7:
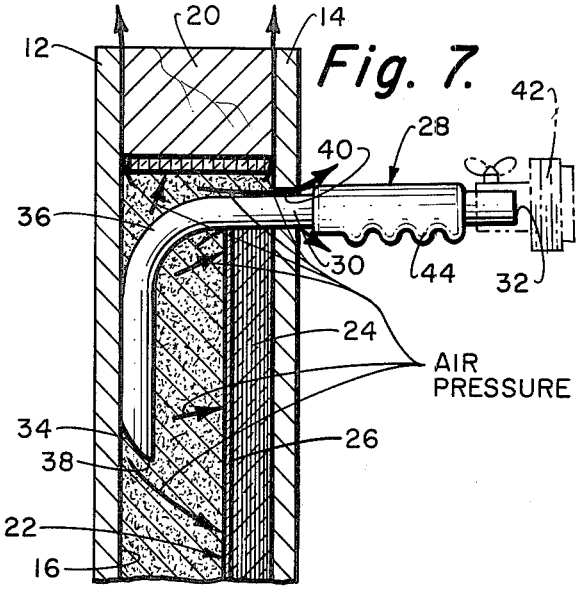
FIG. 7 is a view similar to FIG. 6 but showing the interior appearance of the wall after the blowing of insulation there within.

As the tubular member 30 is continued to be pivoted, the tool merely displaces the layer 26 of material until finally the tool assumes a position shown in FIG. 6 of the drawing. At this particular time, it is then desirable to connect the tubular member 30 to an insulation blowing machine (not shown) so that insulation can be moved by air pressure through the interior of the tubular member 30. A conventional type of fitting 42 is to be secured to the end 32 and hence to the insulation blowing machine. Also attached to the tubular member 30 is a handle 44 to facilitate the pivoting motion of the tubular member.

With the tubular member 30 connected to the insulation blowing machine, the insulation is transmitted through the member 30 which causes the blown insulation to be deposited within the chamber 16. This presence of air pressure and insulation causes physical displacement of the backing strip 26 toward the outer wall 14 and a substantial compression of the fiberglass pad 24. The result is a cavity where higher quality insulation will be supplied to within every chamber within the wall structure 10.

It is understood that the foregoing procedure will be repeated for each and every access opening 40. After the insulation has been supplied within the wall structure 10, the access openings 40 will be closed.

What is claimed is:

1. In combination with an existing wall structure being formed of an inner wall surface, an outer wall surface, with there being an enlarged opening therebetween, a layer of insulation located within said opening, said layer insulation being composed of a pad of insulative material which is secured to a backing layer of material, said backing layer of material located adjacent said inner wall surface, a tool to facilitate the blowing of additional insulation within said opening, said tool comprising:

an elongated tubular member having an internal chamber to facilitate the passage of blown insulation therethrough, said tubular member having an inner end and an outer end, said inner end adapted to be connected to an insulation blowing machine, said outer end terminating in a cutting edge, said outer end being angularly located with respect to said inner end, an access opening being provided through said outer wall connecting with said internal enlarged opening, the outer end of said tool to be inserted through said access opening and to be moved cutting through said pad of insulation into contact with said backing layer of material, upon pivoting of said tool said cutting edge cuts through said backing layer of material until further pivoting motion of said tool results in said outer end to be located between said backing layer of material and said inner wall surface, whereupon conducting of insulation through said tubular member such is deposited between said backing layer of material and said inner wall thereby compressing said pad of insulation thereby permitting a substantial higher quality and greater amount of insulation to be supplied within said opening.

2. The combination as defined in claim 1 wherein:

said outer end of said tool being smoothly contoured so as to facilitate pivoting motion of said tool against said inner wall.

3. The combination as defined in claim 2 wherein:

the angular displacement of said outer end from said inner end being substantially 90°.

4. The method of blowing insulation within an existing wall structure which is formed of an outer wall and an inner wall with an internal chamber located therebetween with there also being a pad of existing insulative material located within said internal chamber, the pad of insulative material including a backing layer of material located adjacent said inner wall, the method comprising steps of:

forming an access opening through said outer wall connecting with said opening;

inserting an elongated tubular member through said access opening with the free end of said tubular member including a cutting edge;

moving said tool through outside backing material if present and the pad of insulation thereby cutting such until the cutting edge comes in contact with the backing layer of material;

causing said tool to pivot thereby cutting said inside backing layer of material forming an opening therein;

continuing to pivot said tool until it no longer cuts the backing layer of material but is located between the backing layer of material and the inner wall;

supplying pulverized insulation material through said tool to be deposited within said enlarged opening or chamber in substantial quantity.

* * * * *